US009156157B2

(12) United States Patent
Wang

(10) Patent No.: US 9,156,157 B2
(45) Date of Patent: Oct. 13, 2015

(54) TOOL BOX WITH STORAGE MEMBERS

(71) Applicant: Eupin Wang, New Taipei (TW)

(72) Inventor: Eupin Wang, New Taipei (TW)

( * ) Notice: Subject to any disclaimer, the term of this patent is extended or adjusted under 35 U.S.C. 154(b) by 0 days.

(21) Appl. No.: 14/205,199

(22) Filed: Mar. 11, 2014

(65) Prior Publication Data

US 2015/0258677 A1 Sep. 17, 2015

(51) Int. Cl.

| | |
|---|---|
| ***B65D 85/20*** | (2006.01) |
| ***B25H 3/02*** | (2006.01) |
| ***B65D 21/08*** | (2006.01) |
| ***B65D 43/16*** | (2006.01) |

(52) U.S. Cl.

CPC ..... *B25H 3/021* (2013.01); *B65D 21/083* (2013.01); *B65D 43/16* (2013.01)

(58) Field of Classification Search

CPC ..... B25H 3/003; B25H 3/023; B25H 3/025; B25H 3/021; A47F 7/0028; A47F 5/02; Y10S 312/902; B65D 85/20

USPC ..... 206/377, 349, 376, 378, 379, 372, 373; 211/70.6, 69, 170, 163

See application file for complete search history.

(56) References Cited

U.S. PATENT DOCUMENTS

| | | | | |
|---|---|---|---|---|
| 6,405,864 | B1 * | 6/2002 | Streich et al. | 206/373 |
| 6,755,302 | B1 * | 6/2004 | Streich et al. | 206/373 |
| RE38,905 | E * | 12/2005 | Wei | 206/373 |
| 7,322,470 | B2 * | 1/2008 | Brunson | 206/372 |
| 7,900,771 | B1 * | 3/2011 | Meng | 206/379 |
| 7,931,143 | B1 * | 4/2011 | Lin | 206/373 |
| 8,651,348 | B2 * | 2/2014 | Meng | 224/245 |
| 2009/0266730 | A1 * | 10/2009 | Lin | 206/372 |
| 2011/0031145 | A1 * | 2/2011 | Larson et al. | 206/372 |

* cited by examiner

*Primary Examiner* — Steven A. Reynolds

(74) *Attorney, Agent, or Firm* — Patent Office of Bang Shia

(57) ABSTRACT

A tool box includes two pivoted halves and a chamber with a bottom and two opposite walls. A plurality of positioning units formed in the walls each include a positioning cavity located in one direction, a first guide groove located farther from the bottom than the positioning cavity, a first pivot cavity at one end of the first guide groove and located in the one direction, a second pivot cavity formed at another end of the first guide groove and located in another direction, a second guide groove and located between the first pivot and positioning cavities, a third pivot cavity formed at one end of the second guide groove, located in the two directions and disposed between the first pivot and positioning cavities, and a fourth pivot cavity formed at another end of the second guide groove and located between the second pivot cavity and the bottom.

4 Claims, 8 Drawing Sheets

TOOL BOX WITH STORAGE MEMBERS

BACKGROUND OF THE INVENTION

1. Field of the Invention

The present invention relates to a tool box, and more particularly to a tool box with storage members to store tools, such as screwdriver head, and sockets.

2. Description of the Prior Art

Tool boxes used for storage of tools, such as screwdriver head, socket, are normally provided with a cushion or a storage member, and the screwdriver heads or sockets can be inserted in the cushion or storage member for easy recognition or pick up by the user. However, the screwdriver heads or sockets can not be pivoted in the tool boxes for exhibition purpose.

The present invention has arisen to mitigate and/or obviate the afore-described disadvantages.

SUMMARY OF THE INVENTION

The primary objective of the present invention is to provide a tool box which storage members, wherein the storage members are allowed to pivot and then fixed in the tool box, so as to improve the functionality of the tool box.

To achieve the above objective, a tool box with storage members in accordance with the present invention comprises: two halves, a plurality of positioning units, and at least one storage member. The two halves are pivoted to each other to form the tool box and capable of being opened and closed with respect to each other, at least one of the two halves is formed with a chamber which includes a bottom and two opposite walls. The positioning units are disposed on the walls, and each of the positioning units includes a positioning cavity which is formed in the walls and located in a first direction, a first arc-shaped guide groove which is formed in the walls and located farther from the bottom than the positioning cavity, a first pivot cavity which is formed at one end of the first arc-shaped guide groove and located in the first direction, a second pivot cavity which is formed at another end of the first arc-shaped guide groove and located in a second direction, a second arc-shaped guide groove which is formed in the walls and located between the first pivot cavity and the positioning cavity, a third pivot cavity which is formed at one end of the second arc-shaped guide groove, located in both the first and second directions and disposed between the first pivot cavity and the positioning cavity, and a fourth pivot cavity which is formed at another end of the second arc-shaped guide groove and located between the second pivot cavity and the bottom. The storage member is pivotally and removably disposed in the chamber, and includes at least one tool-insertion cavity and two lateral surfaces located toward the two walls. Each of the lateral surface includes a first pivot and a second pivot. When the first pivot is pivotally disposed in the positioning cavity, the second pivot is positioned in the third or fourth pivot cavities, and when the first pivot is disposed in the third pivot cavity, the second pivot will be positioned in the first or second pivot cavities.

Preferably, the first direction is perpendicular to the second direction.

Preferably, a distance from the positioning cavity to the third pivot cavity is equal to a distance from the positioning cavity to the fourth pivot cavity.

Preferably, a distance from the third pivot cavity to the first pivot cavity is equal to a distance from the third pivot cavity to the second pivot cavity.

DETAILED DESCRIPTION OF THE PREFERRED EMBODIMENTS

Figure 1:
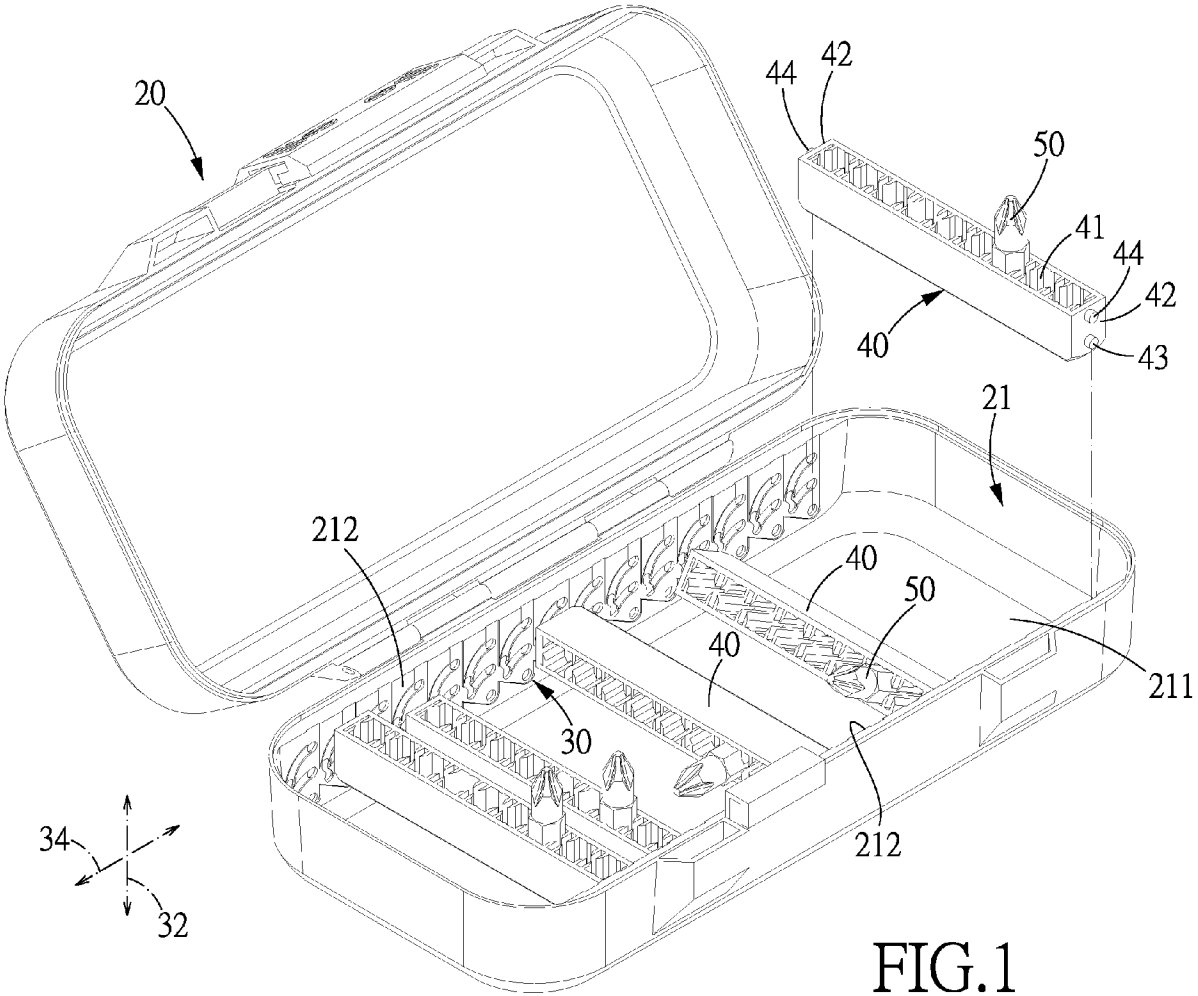
FIG. 1 is a perspective view of a tool box in accordance with a first embodiment of the present invention.

The present invention will be clearer from the following description when viewed together with the accompanying drawings, which show, for purpose of illustrations only, the preferred embodiment in accordance with the present invention.

Referring to FIGS. 1-4, a tool box in accordance with the present invention is shown and comprises: two halves 20, a plurality of positioning units 30, and five storage members 40.

The two halves 20 are pivoted to each other to form the tool box, and capable of being opened and closed with respect to each other. At least one of the two halves 20 is formed with a chamber 21 which includes a bottom 211 and two opposite walls 212. Since the two halves 20 of the tool box are of conventional structures, further description would be omitted here.

The positioning units 30 are disposed on the two walls 212, and each include a positioning cavity 31 which is formed in the walls 212 and located in a first direction 32, a first arc-shaped guide groove 33 which is formed in the walls 212 and located farther from the bottom 211 than the positioning cavity 31, a first pivot cavity 331 which is formed at one end of the first arc-shaped guide groove 33 and located in the first direction 32, a second pivot cavity 332 which is formed at another end of the first arc-shaped guide groove 33 and located in a second direction 34, a second arc-shaped guide groove 35 which is formed in the walls 212 and located between the first pivot cavity 331 and the positioning cavity 31, a third pivot cavity 351 which is formed at one end of the second arc-shaped guide groove 35, located in both the first and second directions 32, 34 and disposed between the first pivot cavity 331 and the positioning cavity 31, and a fourth pivot cavity 352 which is formed at another end of the second arc-shaped guide groove 35 and located between the second pivot cavity 332 and the bottom 211. In this embodiment, the first direction 32 is perpendicular to the bottom 211 of the chamber 21, and the second direction 34 is perpendicular to the first direction 32. A distance L1 from the positioning cavity 31 to the third pivot cavity 351 is equal to a distance L2 from the positioning cavity 31 to the fourth pivot cavity 352, and a distance L3 from the third pivot cavity 351 to the first pivot cavity 331 is equal to a distance L4 from the third pivot cavity 351 to the second pivot cavity 332.

The five storage members 40 are identical structures pivotally and removably disposed in the chamber 21, and each include at least one tool-insertion cavity 41 and two lateral surfaces 42 located toward the two walls 212. Each of the lateral surface 42 includes a first pivot 43 and a second pivot 44. When the first pivot 43 is pivotally disposed in the positioning cavity 31, the second pivot 44 will be positioned in the third or fourth pivot cavities 351, 352. When the first pivot 43 is disposed in the third pivot cavity 351, the second pivot 44 will be positioned in the first or second pivot cavities 331, 332.

What mentioned above are the structures of the present invention, for a better understanding of the invention, its operating advantages and the specific objects attained by its uses, reference should be had to the following descriptive matter.

Each of the storage members 40 can be pivoted and fixed in the following four ways.

Figure 4:
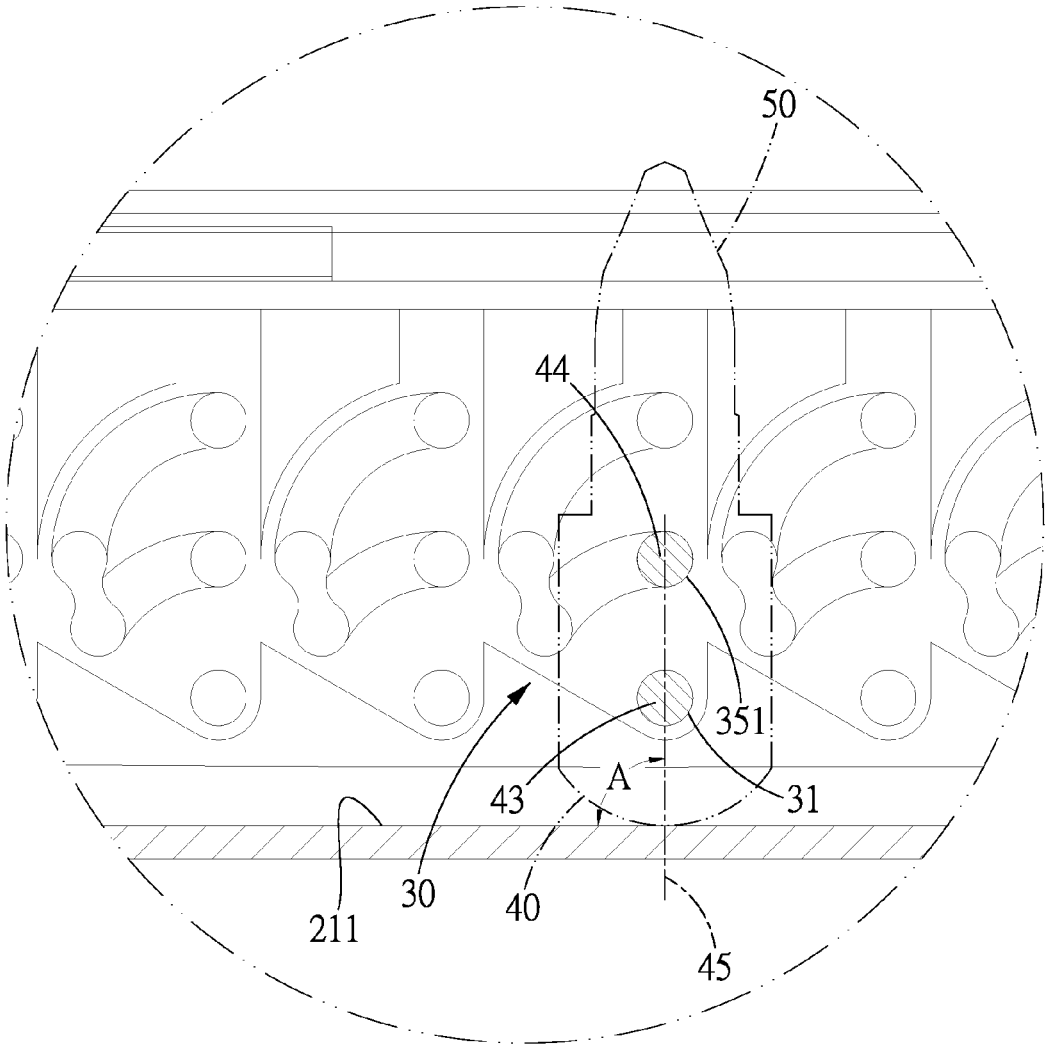
FIG. 4 is an enlarged view of a part of the tool box in accordance with the present invention, wherein the storage member is fixed in a first vertical manner.

First, the storage member 40 (only one storage member 40 described for easy explanation) is pivoted and fixed in the vertical direction in the first manner. As shown in FIGS. 1 and 4, firstly, the first pivot 43 of the storage member 40 is pivotally disposed in the positioning cavity 31 of the positioning unit 30, and the second pivot 44 is positioned in the third pivot cavity 351 of the same positioning unit 30. At this moment, the tool-insertion cavity of the storage member 40 vertically opens upward (as shown in the figures, the connecting line 45 between the first and second pivots 43, 44 defines an angle A which is 90 degrees with respect to the bottom 211), so that the screwdriver head 50 inserted in the too-insertion cavity is held in a vertical manner for easy recognition and pick up by the user.

Figure 5:
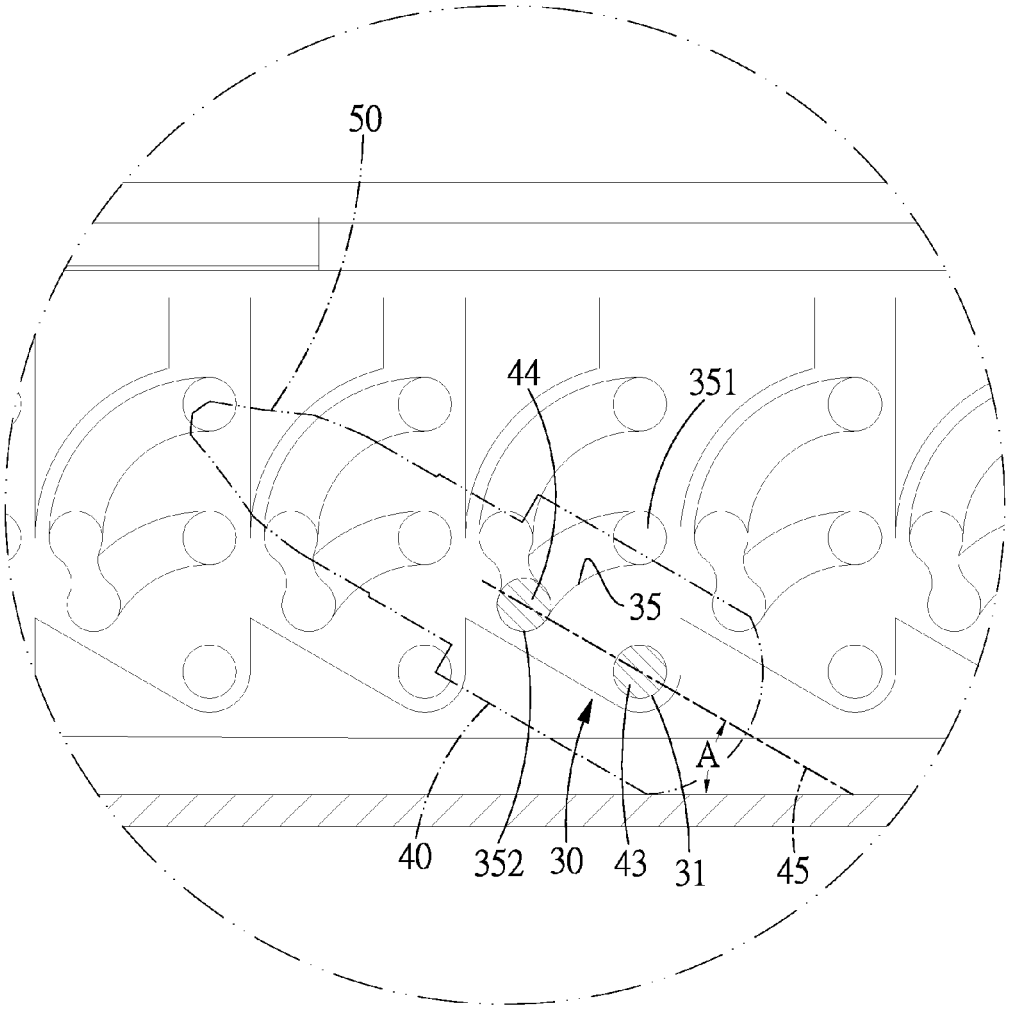
FIG. 5 is an enlarged view of a part of the tool box in accordance with the present invention, wherein the storage member pivots an angle and fixed in an inclined manner.

Second, the storage member 40 is fixed after pivoting an angle. As shown in FIGS. 1, 4 and 5, the storage member 40 is fixed in the vertical direction in the first manner, and the first pivot 43 of the storage member 40 is still pivotally disposed in the positioning cavity 31 of the positioning unit 30. Then the storage member 40 pivots around the first pivot 43 to make the second pivot 44 rotate counterclockwise from the third pivot cavity 351 toward the fourth pivot cavity 352, when rotating, the second pivot 44 is guided by second arc-shaped guide groove 35 to move from the third pivot cavity 351 into the fourth pivot cavity 352. At this moment, the tool-insertion cavity of the storage member 40 has been pivoted an angle and fixed in an inclined position (as shown in the figures, the connecting line 45 between the first and second pivots 43, 44 defines an angle A which is 30 degrees with respect to the bottom 211), so that the screwdriver head 50 inserted in the too-insertion cavity is held in an inclined position, which is also for easy recognition and pick up by the user.

Figure 6:
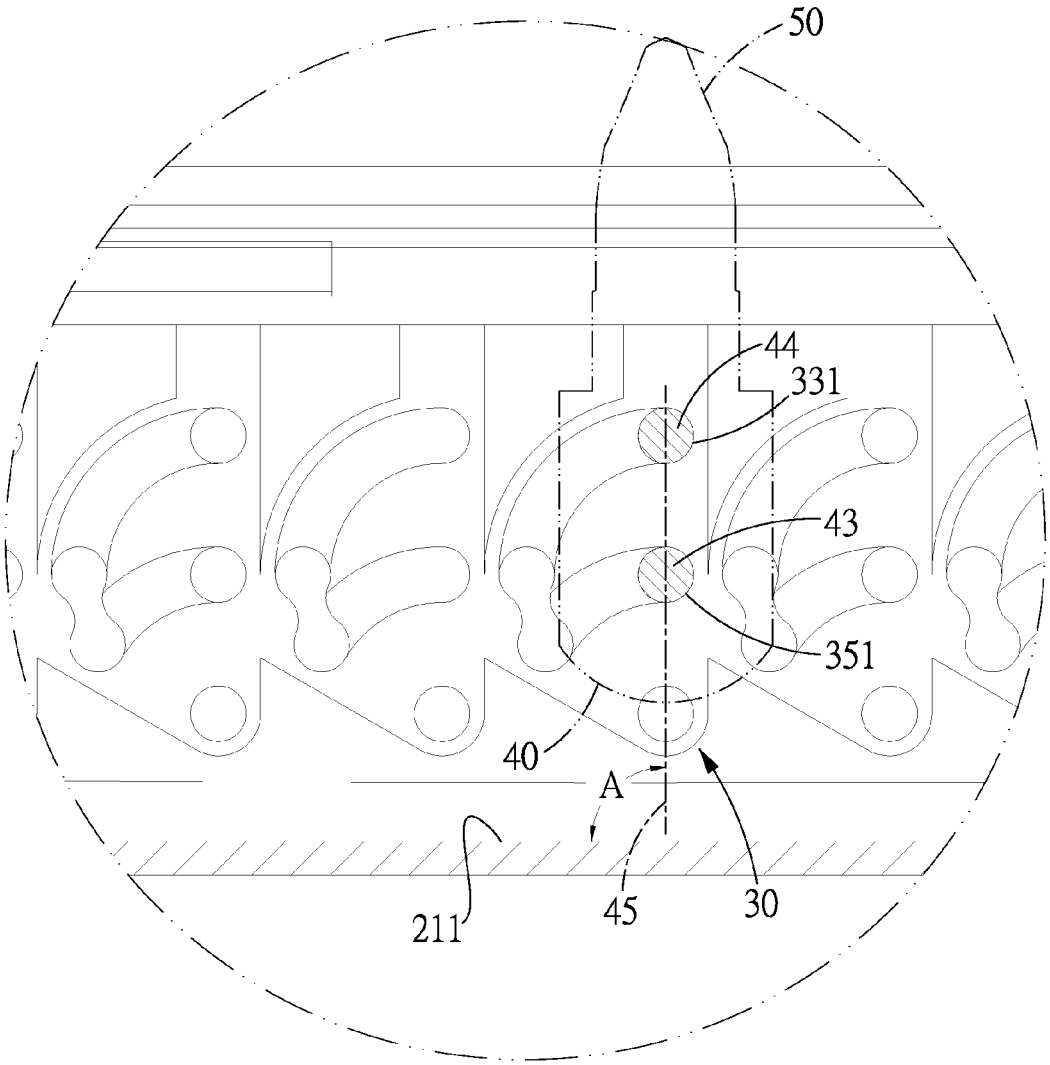
FIG. 6 is an enlarged view of a part of the tool box in accordance with the present invention, wherein the storage member is fixed in a second vertical manner.

Third, the storage member 40 is pivoted and fixed in the vertical direction in a second manner. As shown in FIGS. 1 and 6, firstly, the first pivot 43 of the storage member 40 is pivotally disposed in the third pivot cavity 351 of the positioning unit 30, and the second pivot 44 is positioned in positioning cavity 31 of the same positioning unit 30. At this moment, the tool-insertion cavity of the storage member 40 vertically opens upward (as shown in the figures, the connecting line 45 between the first and second pivots 43, 44 defines an angle A which is 90 degrees with respect to the bottom 211), so that the screwdriver head 50 inserted in the too-insertion cavity is held in a vertical manner for easy recognition and pick up by the user. The difference of FIG. 6 from FIG. 4 is that the storage member 40 of FIG. 6 is located farther from the bottom 211 than the storage member 40 of FIG. 4, so that the screwdriver head 50 can protrude more (than in the first vertical position), or the tool-insertion cavity of the storage member 40 can be designed to be more deep to hold longer screwdriver head 50.

Figure 7:
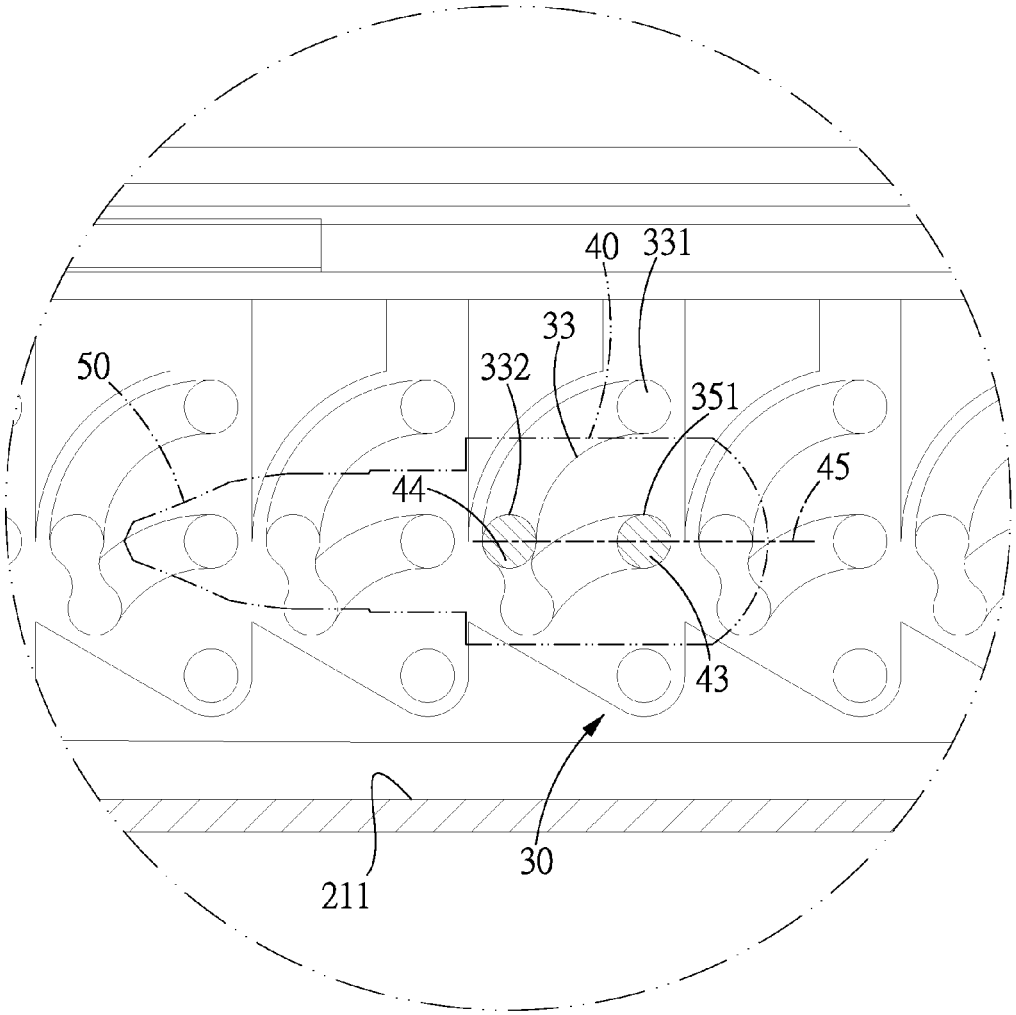
FIG. 7 is an enlarged view of a part of the tool box in accordance with the present invention, wherein the storage member pivots an angle and is fixed in a horizontal manner.

Fourth, the storage member 40 is fixed in a horizontal position. As shown in FIGS. 1, 6 and 7, the storage member 40 is fixed in the vertical direction in the second manner, and the first pivot 43 of the storage member 40 is still pivotally disposed in the third pivot cavity 351 of the positioning unit 30. Then the storage member 40 pivots around the first pivot 43 to make the second pivot 44 rotate counterclockwise from the first pivot cavity 331 toward the second pivot cavity 332, while rotating, the second pivot 44 is guided by first arc-shaped guide groove 33 to move from the first pivot cavity 331 into the second pivot cavity 332. At this moment, the tool-insertion cavity of the storage member 40 is fixed in a horizontal position (as shown in the figures, the connecting line 45 between the first and second pivots 43, 44 is in parallel to the bottom 211), so that the screwdriver head 50 inserted in the too-insertion cavity is also held in a horizontal position for easy recognition and pick up by the user.

As described above, the storage member 40 of the present invention can be pivoted and fixed in four manners with respect to the tool box, namely, the first vertical manner, inclined manner, second vertical manner and horizontal manner.

Figure 2:
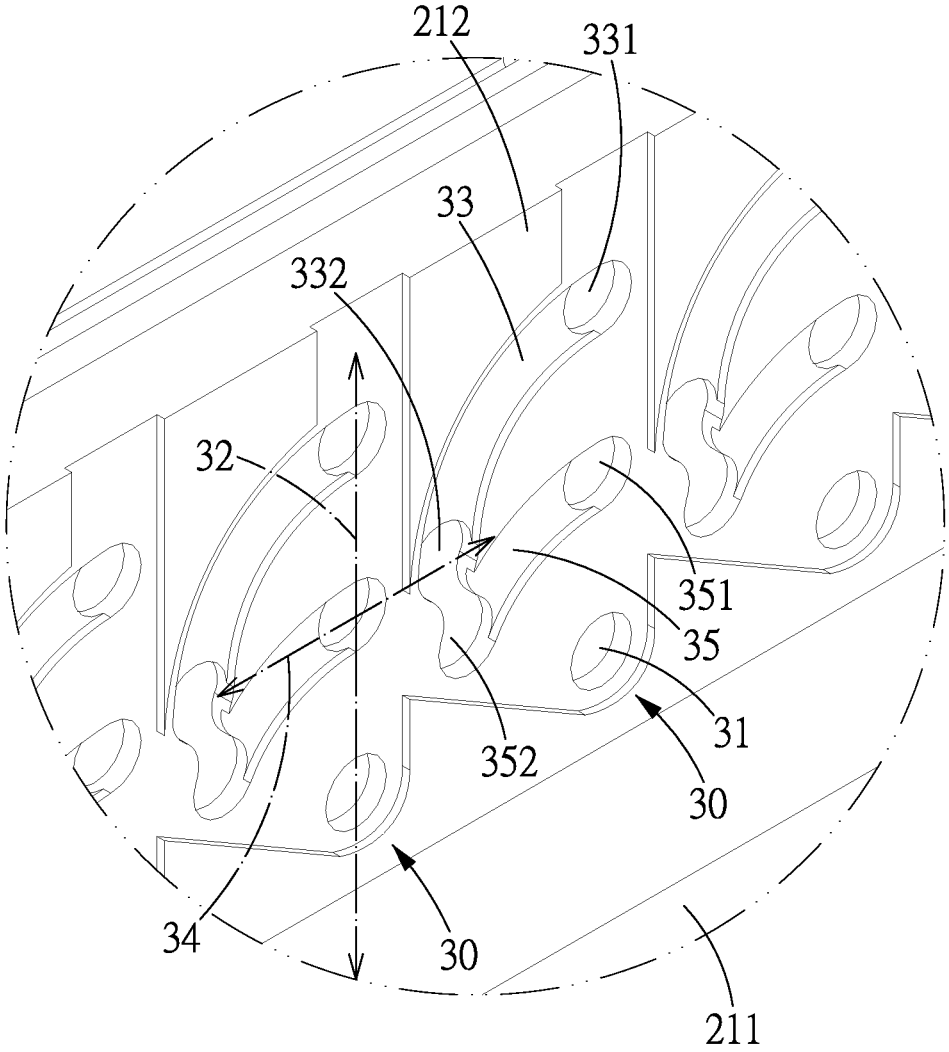
FIG. 2 is an enlarged view of a part of FIG. 1.
Figure 3:
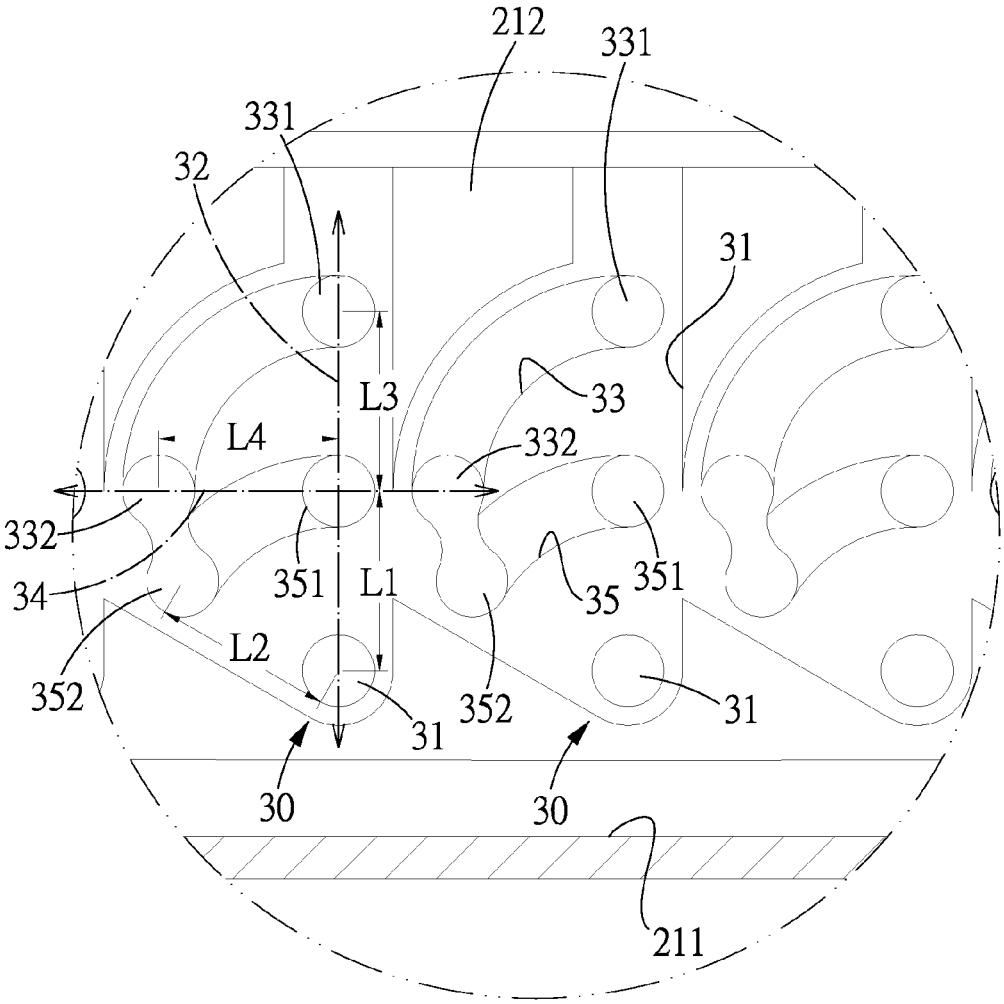
FIG. 3 is another enlarged view of a part of FIG. 1.

It is to be noted that, as shown in FIGS. 1, 2 and 4, between the first and second pivot cavities 331, 332 is defined the first arc-shaped guide groove 33, and between the third and fourth pivot cavities 351, 352 is defined the second arc-shaped guide groove 35. Hence, the second pivot 44 of the storage member 40 can be guided by the first or second arc-shaped guide groove 33, 35 to smoothly slide between the first and second pivot cavities 331, 332 or between the third and fourth pivot cavities 351, 352, which makes it easy to assemble or fix the storage member 40.

Figure 8:
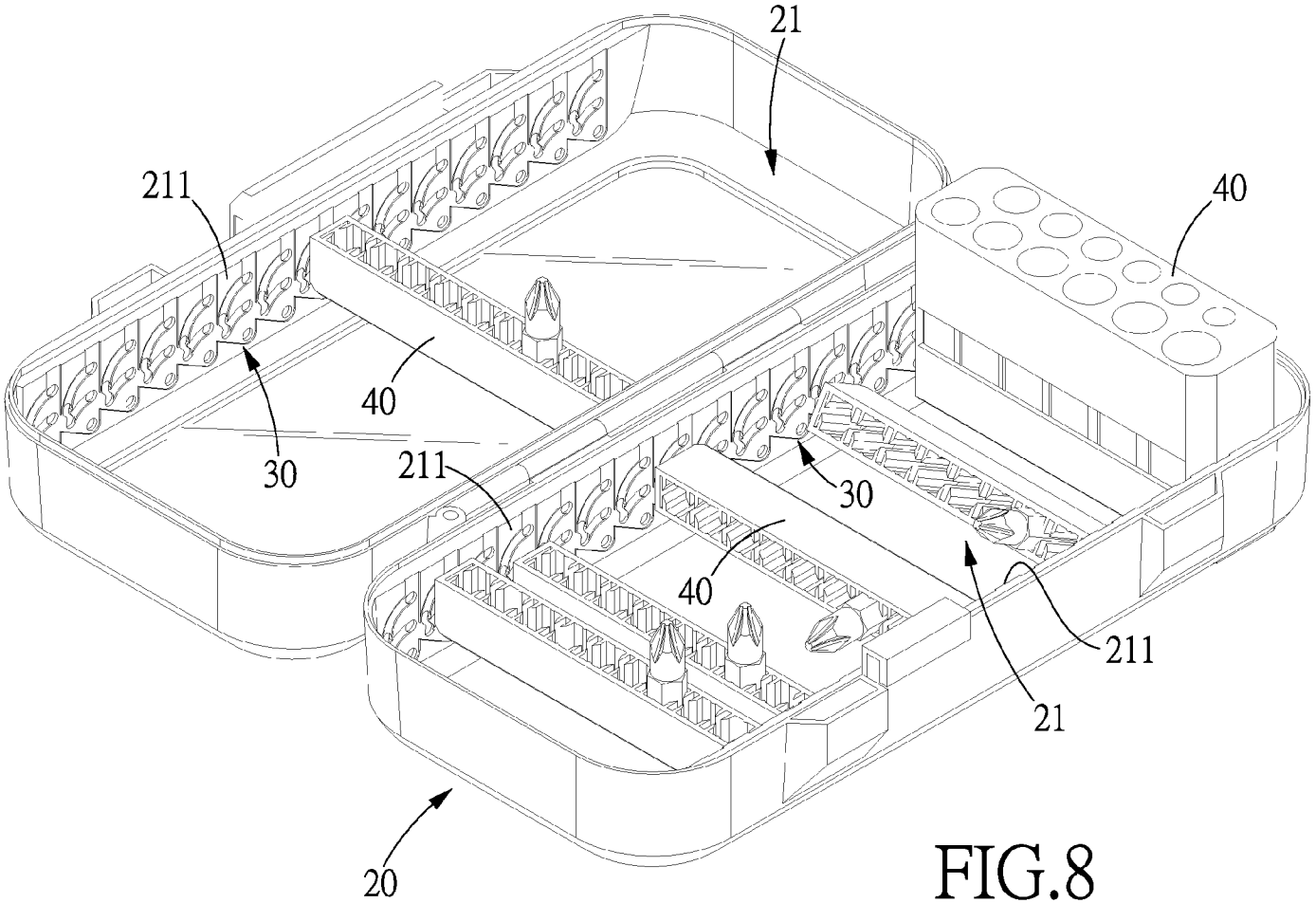
FIG. 8 is a perspective view of a tool box in accordance with a second embodiment of the present invention.

FIG. 8 shows another embodiment of the present invention, wherein both of the halves 20 of the tool box are provided with a chamber 21, and the positioning units 30 are positioned between the two walls 212 of each of the halves 20, so as to improve the storage capacity of the tool box.

While we have shown and described various embodiments in accordance with the present invention, it is clear to those skilled in the art that further embodiments may be made without departing from the scope of the present invention.

What is claimed is:

1. A tool box with storage members comprising:

two halves pivoted to each other to form the tool box and capable of being opened and closed with respect to each other, at least one of the two halves being formed with a chamber which includes a bottom and two opposite walls;

a plurality of positioning units disposed on the walls, and each of the positioning units including a positioning cavity which is formed in the walls and located in a first direction, a first arc-shaped guide groove which is formed in the walls and located farther from the bottom than the positioning cavity, a first pivot cavity which is formed at one end of the first arc-shaped guide groove and located in the first direction, a second pivot cavity which is formed at another end of the first arc-shaped guide groove and located in a second direction, a second arc-shaped guide groove which is formed in the walls and located between the first pivot cavity and the positioning cavity, a third pivot cavity which is formed at one end of the second arc-shaped guide groove, located in both the first and second directions, and disposed between the first pivot cavity and the positioning cavity, and a fourth pivot cavity which is formed at another end of the second arc-shaped guide groove and located between the second pivot cavity and the bottom;

at least one said storage member pivotally and removably disposed in the chamber, and including at least one tool-insertion cavity and two lateral surfaces located toward the two walls, each of the lateral surface including a first pivot and a second pivot, when the first pivot is pivotally disposed in the positioning cavity, the second pivot is positioned in the third or fourth pivot cavities, when the first pivot is disposed in the third pivot cavity, the second pivot will be positioned in the first or second pivot cavities;

wherein the first pivot cavity, the third pivot cavity and the positioning cavity of each of the positioning units are located along a straight line perpendicular to the bottom of the chamber of the tool box, and the connecting lines of the positioning units are parallel to one another.

2. The tool box with storage members as claimed in claim 1, wherein the first direction is perpendicular to the second direction.

3. The tool box with storage members as claimed in claim 1, wherein a distance from the positioning cavity to the third pivot cavity is equal to a distance from the positioning cavity to the fourth pivot cavity.

4. The tool box with storage members as claimed in claim 1, wherein a distance from the third pivot cavity to the first pivot cavity is equal to a distance from the third pivot cavity to the second pivot cavity.

* * * * *